US007340860B2

(12) United States Patent
Balbo Di Vinadio

(10) Patent No.: US 7,340,860 B2
(45) Date of Patent: Mar. 11, 2008

(54) SAFETY ASSEMBLY FOR A CASEMENT WINDOW OR DOOR

(75) Inventor: Aimone Balbo Di Vinadio, Turin (IT)

(73) Assignee: Savio S.p.A., Chiusa San Michele (Torino) (IT)

( * ) Notice: Subject to any disclaimer, the term of this patent is extended or adjusted under 35 U.S.C. 154(b) by 107 days.

(21) Appl. No.: 11/122,639

(22) Filed: May 5, 2005

(65) Prior Publication Data

US 2005/0246979 A1 Nov. 10, 2005

(30) Foreign Application Priority Data

May 5, 2004 (IT) ..... TO2004A0288

(51) Int. Cl.
*E05D 15/522* (2006.01)

(52) U.S. Cl. ..... 49/192; 49/193; 49/382

(58) Field of Classification Search ..... 49/192, 49/193, 382; 292/137, 138, 162, 145, 150, 292/302, DIG. 20, DIG. 47
See application file for complete search history.

(56) References Cited

U.S. PATENT DOCUMENTS 2,305,411 A * 12/1942 Fitzpatrick ..... 292/150
3,994,093 A * 11/1976 Mayer et al. ..... 49/192
4,074,462 A * 2/1978 McHeffey ..... 49/192
4,208,838 A * 6/1980 Kleine et al. ..... 49/192
4,400,026 A * 8/1983 Brown, Jr. ..... 292/175
4,637,165 A * 1/1987 Schneider ..... 49/192
4,739,583 A * 4/1988 Tonsmann et al. ..... 49/192
5,226,256 A * 7/1993 Fries et al. ..... 49/13
5,881,498 A * 3/1999 Goggin et al. ..... 49/192
6,421,960 B1 * 7/2002 Manzella ..... 49/192
7,017,301 B2 * 3/2006 Balbo Di Vinadio ..... 49/192

* cited by examiner

*Primary Examiner*—Gregory J. Strimbu
(74) *Attorney, Agent, or Firm*—Heslin Rothenberg Farley & Mesiti P.C.; Victor A. Cardona

(57) ABSTRACT

A safety assembly for an actuating linkage of a metallic casement window or door includes an "L" shaped guiding body fastenable on the exterior of the movable frame of the window or door, a first and a second slidable member mounted slidably on the guiding body, a flexible element that interconnects the slidable members, and a safety block. A bolt is mounted in the block and is slidable transversely relative to the direction of motion of the first slidable member and against the action of a spring. The body has two transverse guides between which the safety block is inserted. The first member has two segments with different heights and the safety block has an opening oriented towards the body and directed in the longitudinal direction of the first slidable member to prevent motion of the safety block.

3 Claims, 6 Drawing Sheets

SAFETY ASSEMBLY FOR A CASEMENT WINDOW OR DOOR

CROSS-REFERENCE TO RELATED APPLICATIONS

This application claims priority from Italian Patent Application No. TO2004A000288 filed on May 5, 2004, the entire disclosure of which is incorporated herein by reference.

FIELD OF THE INVENTION

The present invention relates to accessories for metallic window and door frames constituted by light alloy section bars and in particular it pertains to a corner and safety transmission assembly for an actuating linkage of a metallic window or door frame with swivel wing.

SUMMARY OF THE INVENTION

These frames are provided with a cremone bolt handle coupled with a linkage that is able to lock the movable frame in a closed position or to allow the wing opening by rotation around a vertical side or swivel opening by rotation around the lower horizontal side.

To the actuating linkage is associated a safety block whose function is to prevent the linkage from being operated by means of the handle when the window or door is open in wing or swivel mode.

A corner transmission assembly provided with such a safety block is disclosed in Italian utility model no. 213023 by the same Applicant.

The object of the present invention is to provide a corner and safety transmission assembly which enables to simplify the process of mounting the safety block on the frame with respect to the known solution described in the Italian utility model no. 213023.

According to the present invention, said object is achieved by a corner transmission assembly.

BRIEF DESCRIPTION OF THE DRAWINGS

The present invention shall now be described in detail with reference to the accompanying drawings, provided purely by way of non limiting example, in which.

DETAILED DESCRIPTION OF THE DRAWINGS

Figure 1:
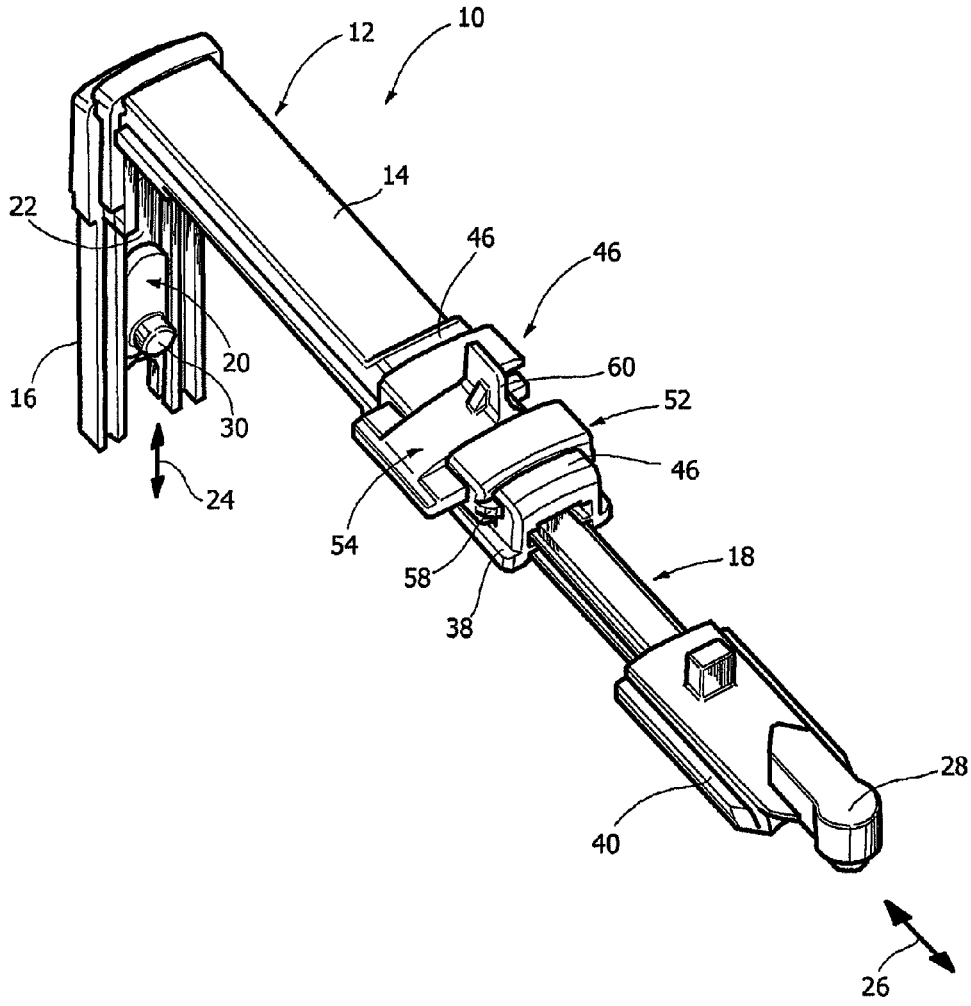
FIG. 1 is a perspective view of a transmission assembly according to the present invention.

With reference to FIG. 1, the number 10 designates a safety corner transmission assembly according to the present invention. The transmission assembly 10 is intended for use on metallic window or door frames with swivel wing. In particular, the transmission assembly 10 is mounted on the movable frame, in the upper openable corner region, i.e. in the region that can be removed from the fixed frame both in the wing and in the swivel opening mode. The transmission assembly 10 comprises a guiding body 12 made of metallic or plastic material with an "L" shape, provided with two mutually orthogonal branches 14, 16. The two branches 14, 16 are provided with respective longitudinal guides engaged by respective slidable members 18, 20. In known fashion, the two slidable members 18, 20 are fastened at the opposite ends of a flexible metallic element 22 formed, for example, by three metallic laminas, which extends along the two branches 14, 16 of the guiding body 12 and which is able to actuate the sliding of the slidable member 20 in the direction indicated by the double arrow 24 in FIG. 1 as a result of the movement of the slidable member 18 in the direction indicated by the double arrow 26 in the same figure. The two slidable members 18, 20 are provided with respective connecting elements 28, 30 for connection to transmission rods (not shown) of the control linkage.

Figure 2:
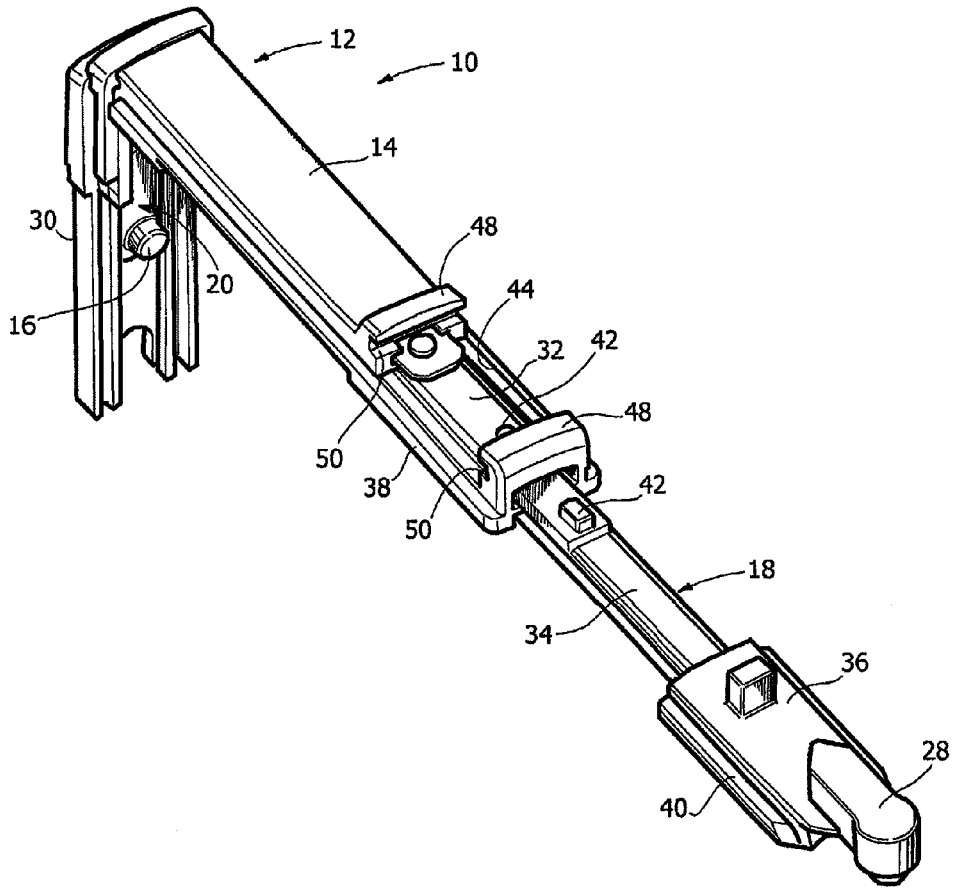
FIG. 2 is a perspective view of the transmission assembly of FIG. 1 without the safety block.

With reference in particular to FIG. 2, the slidable member 18 comprises a part shaped as a rod subdivided into two segments 32, 34 with a different height with respect to the sliding plane of the member 18. In particular, the segment 32 has an upper surface positioned at a greater height than the upper surface of the segment 34. The segment 34 bears at its distal end an element 36 with greater width whereon is formed the connecting portion 28. The branch 14 of the guiding body 12 and the broadened element 36 of the slidable element 18 are provided with lateral wings 38, 40 for engagement within the edges of a groove of the metallic section bar which constitutes an upright of the movable frame.

The segment with greater height 32 of the slidable member 18 is provided with engagement formations 42 constituted by two integral elements which project from the upper surface of the segment 32.

The guiding body 12 has, at an end of the branch 14, a seat 44 (FIG. 2) able to receive a safety block 46. With reference in particular to FIG. 2, the seat 44 has a through central opening and two transverse guiding elements 48 provided with respective transverse channel guides 50.

Figure 3:
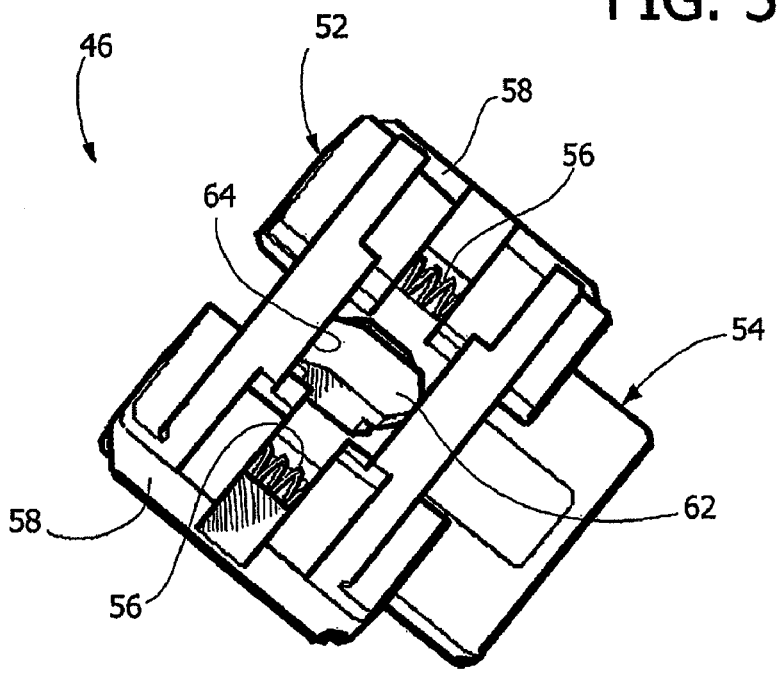
FIGS. 3 and 4 are perspective views of the safety block viewed from its lower side, respectively in the locked position and in the unlocked position.
Figure 4:
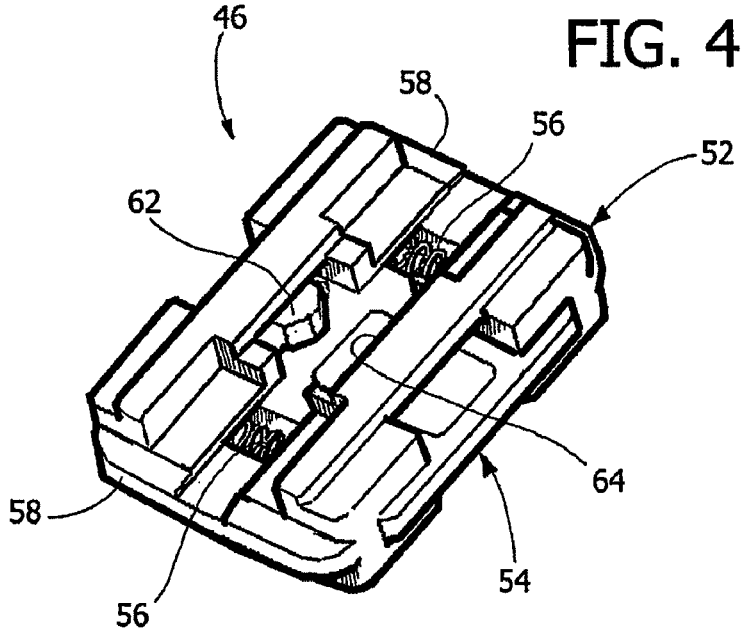

With reference to FIGS. 1, 3 and 4, the safety block 46 comprises a body 52, made of plastic or metallic material, a bolt 54 slidable relative to the body 52 and a pair of helical compression springs 56 positioned between the body 52 and the bolt 54 and tending to thrust the bolt 54 towards a locked position.

The body 52 of the safety block 46 has two parallel outer ribs 58 which slidably engage the transverse guides 50 of the guiding body 12. The bolt 54 is made of metallic or plastic material and it has an actuating portion projecting superiorly 60 which co-operates with the fixed frame of the window or door. On its lower surface, the bolt 54 is provided with an engagement formation 62 that is destined to co-operate in arresting relationship with the engagement formations 42 of the slidable member 18.

The body 52 of the safety block 46 has on its lower side (see FIGS. 3 and 4) an opening with longitudinal development able to receive the segment 32 with greater height of the slidable member 18.

FIGS. 5, 6 and 7, 8 illustrate the manner in which the safety block 46 is mounted on the guiding body 12. To mount the safety block 46, it is necessary to thrust the slidable member 18 in its recessed position with respect to the guiding body 14. In this position, the segment 34 with smaller height of the slidable member 18 is positioned at the seat 44 able to receive the safety block 46. The safety block 46 can thus be inserted into the seat 44 with a movement in the transverse direction positioning the ribs 58 of the safety block 46 into the corresponding transverse guides 50 of the guiding body 12.

Figure 5:
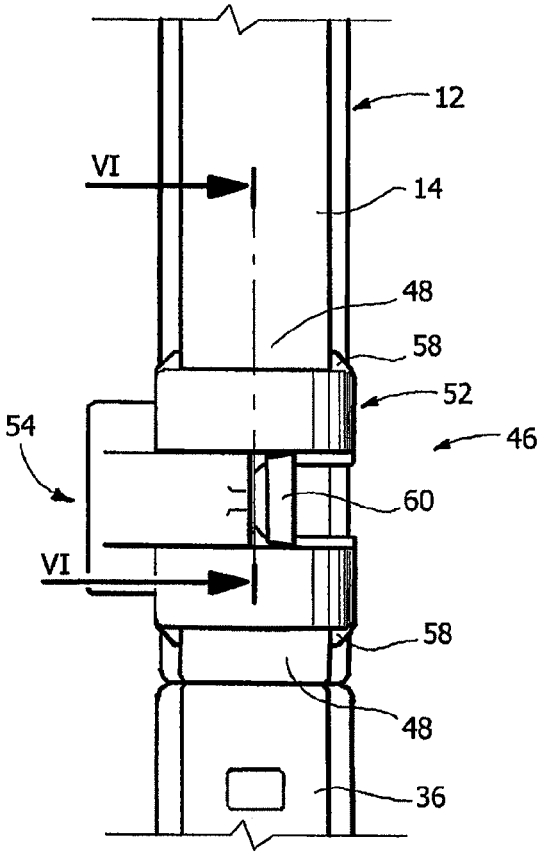
FIG. 5 is a partial plan view of the transmission assembly in the position for mounting the safety block.
Figure 7:
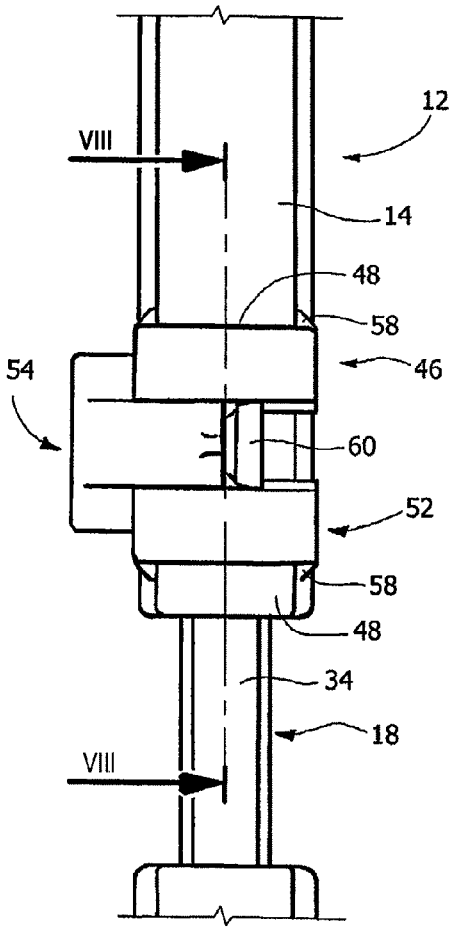
FIG. 7 is a plan view of the transmission assembly in working position.

It should be noted that the safety block can be mounted indifferently in the position illustrated in FIGS. 5 and 7 or in a position that is offset by 180° relative to the illustrated position. This makes the safety block 46 reversible and usable indifferently with rightward or leftward opening windows or doors.

Figure 6:
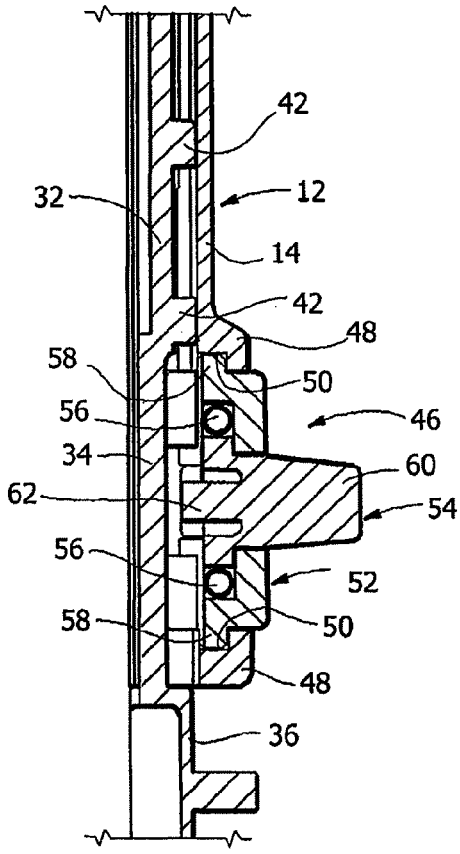
FIG. 6 is a section according to the line VI-VI of FIG. 5.

After inserting the safety block as shown in FIGS. 5 and 6, the mounting operation is completed by thrusting the bolt 54 towards the unlocked position and, simultaneously, extracting the slidable member 18 from the guiding body 12. The position illustrated in FIGS. 7 and 8 is thus reached and mounting is completed.

The safety block 46 is stably fastened to the guiding body 12 because the engagement of the segment with greater height 32 of the slidable member 18 with the longitudinal opening 64 of the safety block 46 prevents a displacement in the transverse direction of the body 52 of the safety block 46.

In the assembled position, the safety block 46 forms an integral part of the transmission assembly and is not to be mounted as an autonomous component on the upright of the window or door frame. The procedure for mounting the corner transmission assembly is greatly simplified with respect to the known solution described in the Italian utility model no. 213023 by the same Applicant.

Figure 8:
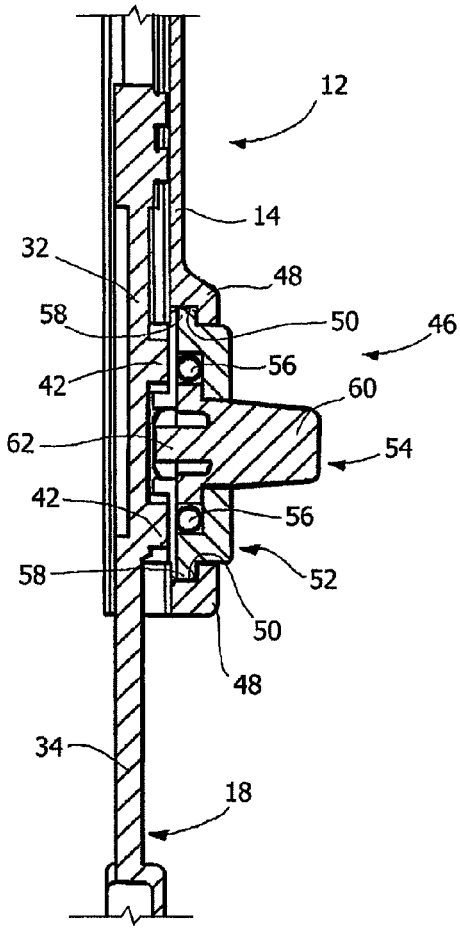
FIG. 8 is a section according to the line VIII-VIII of FIG. 7.
Figure 9:
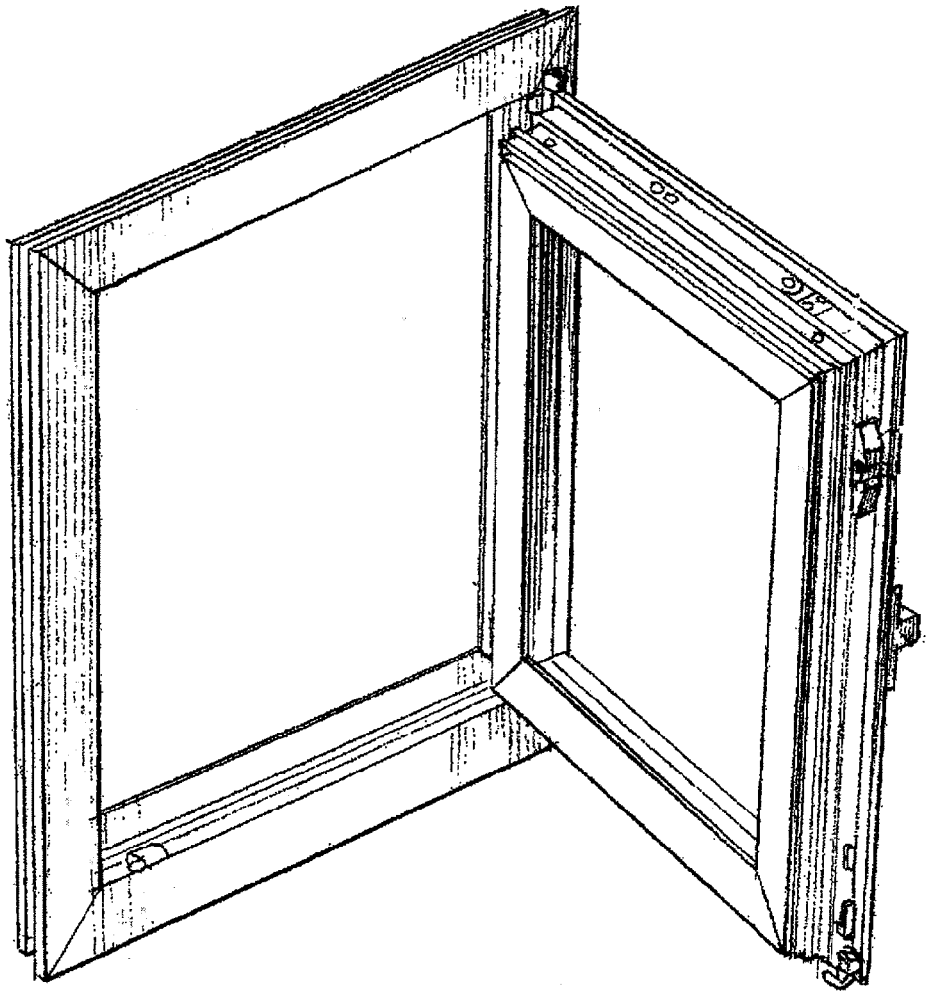
FIG. 9 (Prior Art)
FIG. 9 is a perspective view of a prior art casement window having a fixed frame and a moveable frame.

In use, when the movable frame of the window or door is in the open position, the bolt 54 of the safety block 46 is in its blocking position, illustrated in FIGS. 7 and 8. In this position, the engagement formation 62 of the bolt 54 extends through the displacement trajectory of the engagement formations 42 of the slidable member 18 and prevents the slidable member 18 from completing its work travel.

When the movable frame of the window or door is in a closed position, the bolt 54 moves towards an unlocked position against the action of the elastic means 56 as a result of the engagement of the projection 60 of the bolt 54 against the fixed frame. In the unlocked position of the bolt 54, the engagement formations 62 and 42 are misaligned and the slidable member 18 is free to complete its work travel.

Naturally, without altering the principle of the invention, the construction details and the embodiments may be widely varied from what is described and illustrated herein, without thereby departing from the scope of the invention as defined by the claims that follow.

The invention claimed is:

1. A corner and safety transmission assembly for an actuating linkage of a movable closure, comprising:

an "L" shaped guiding body adapted to be fastened on an exterior of an upper corner of a movable frame of the closure, a first and a second slidable member, mounted slidably on respective branches of the guiding body, the first slidable member being provided with engagement formations, a flexible element that interconnects said first and second slidable members, and a safety block including a body in which is mounted a bolt slidable transversely relative to a direction of motion of the first slidable member and against the action of an elastic member, the bolt slidable to occupy a locking position in which said bolt engages with said engagement formations to prevent movement of said engagement formations relative to said safety block body, said elastic member urges the bolt toward said locking position, and said bolt slidable to an unlocking position in which said bolt does not engage with said engagement formations, the bolt being thrust into the unlocking position against the action of the elastic member as a result of the engagement of the bolt with a fixed frame of the closure when the closure is closed, wherein the guiding body has two guides extending transverse to the direction of motion of the first slidable member, the guides defining a cavity therebetween receiving the body of the safety block, and the first slidable member has a first segment and a second segment, said first segment having a greater height than said second segment, the body of the safety block having on one side oriented towards the guiding body an opening extending in the longitudinal direction of said block, the opening engages said first segment of the first slidable member to prevent a movement of the body of the safety block in a transverse direction relative to the direction of motion of the first slidable member.

2. The transmission assembly as claimed in claim 1, wherein the safety block is configured to be selectively mounted on the guiding body in two positions, offset by 180° with respect to each other.

3. The transmission assembly as claimed in claim 2, wherein the body of the safety block is provided with two ribs that engage said guides of the guiding body.

* * * * *